US005577293A

United States Patent [19]

Meredith et al.

[11] Patent Number: 5,577,293

[45] Date of Patent: Nov. 26, 1996

[54] FULL RECOVERY STRIPPING SYSTEM

[75] Inventors: Oliver D. Meredith, Decatur; Robert M. Rice, Huntsville, both of Ala.

[73] Assignee: Waterjet Systems, Inc., East Hartford, Conn.

[21] Appl. No.: 328,637

[22] Filed: Oct. 24, 1994

[51] Int. Cl.[6] ..... A47L 3/02; A47L 5/04

[52] U.S. Cl. ..... 15/302; 15/322

[58] Field of Search ..... 15/321, 322, 302

[56] References Cited

U.S. PATENT DOCUMENTS

| | | | |
|---|---|---|---|
| 5,028,004 | 7/1991 | Hammelmann | 15/322 X |
| 5,125,126 | 1/1992 | Bonnant | 15/322 X |
| 5,321,869 | 6/1994 | Kaempf | 15/322 |

*Primary Examiner*—Chris K. Moore
*Attorney, Agent, or Firm*—Pamela J. Curbelo

[57] ABSTRACT

A stripping system employing an end-effector with a nozzle and at least one brush circumferentially disposed around that nozzle, and a vacuum device for creating a vacuum between the nozzle and the brush, can remove substances from a substrate with such complete effluent recovery so as to prevent flash rusting of the substrate. The nozzle has orifices, bores, and a plenum chamber such that the plenum chamber is sufficiently large to maintain the desired pressure and amount of liquid to the orifices, the bores have a sufficient length to orient the liquid flowing therethrough in a laminar flow upon reaching the orifices, and the orifices are sized and oriented on the nozzle face in order to produce an even energy profile when the liquid strikes the substrate. The brush has sufficient tuft density and bristle stiffness to allow make-up air into the vacuum while preventing the escape of effluent.

8 Claims, 5 Drawing Sheets

IE
100
75
50
25
IE avg
32
30
0.000
0.500
1.000
Xo(1)
Xo(2)
Xo(3)
Xo(4)

FULL RECOVERY STRIPPING SYSTEM

TECHNICAL FIELD

The present invention relates to a stripping system, and especially relates to a stripping system with a unique end-effector and nozzle configuration.

BACKGROUND OF THE INVENTION

Environmental regulations, particularly the Clean Air and Federal Water Pollution Control Acts, require complete recovery when cleaning or stripping coatings, contaminants, deposits, growths, etc. (hereinafter referred to as substances) from numerous substrates such as ships. This complete recovery requires that no effluent, i.e. water, abrasives and removed substances, drop to and remain on the ground and prohibits open air blasting using dry abrasives without contaminant recovery and treatment. Consequently, conventional removal methods which use hand-held water and dry abrasive guns that do not recover effluent can not be utilized without restricting and recovering the effluent. Restriction and recovery of the effluent is typically very costly and time consuming.

In addition to requiring improvements relating to environmentally sound operation, conventional systems could also benefit from component improvement such as improved nozzle design, size, and weight for both the hand-held and automated removal systems. In hand-held systems, excessive weight results in operator fatigue and muscular problems, while in automated systems, excessive weight causes swivel seal failure and increases system costs and maintenance time. Consequently, an improved nozzle design which is lighter weight and which allows consistent removal of substances from contoured as well as smooth surfaces with greater tolerance would be useful for stripping substrates such as ships, bridges, etc.

Since new environmental regulations demand complete recovery capability and conventional system recoveries employ large containments which are costly, time consuming, and hazardous to operate, what is needed in the art is a unique, system and an improved nozzle which remove and recover substances from even rough and contoured surfaces.

DISCLOSURE OF THE INVENTION

The present invention relates to a stripping system, a method, and a nozzle for removing substances from a surface. The stripping system comprises an end-effector having a nozzle connecting to a liquid supply and at least one brush circumferentially disposed around said nozzle at a sufficient distance from said nozzle to allow the formation of a vacuum therebetween and having bristles arranged in tufts of one or more bristles and sufficient tuft density to prevent the escape of effluent from the end-effector. A vacuum device capable of forming a sufficient vacuum around said nozzle to recover effluent connects to the end-effector such that in combination with the brush orientation, the vacuum formed between the nozzle and the brush is sufficient to substantially completely remove the effluent from the surface.

The method comprises creating a vacuum between a nozzle and brush maintaining contact between the brush and the surface, supplying liquid to the nozzle which sprays the liquid onto the surface such that the substances are removed, and recovering substantially all of the sprayed liquid and removed substances.

The nozzle of the present invention comprises at least one orifice, a plenum chamber for maintaining pressure and uniform liquid supply to said orifice, and a bore connecting each orifice to said plenum chamber, wherein said bore has a sufficient length to cause liquid flowing from said plenum chamber to said orifice to have a laminar flow pattern upon reaching said orifice.

The foregoing and other features and advantages of the present invention will become more apparent from the following description and accompanying drawings.

These drawings are to further illustrate the present invention and are not meant to limit the scope thereof.

BEST MODE FOR CARRYING OUT THE INVENTION

The stripping system of the present invention which is preferably mobile, includes a manipulator, a liquid supply, an effluent separator, an end-effector with a nozzle, at least one brush, and a vacuum device. The liquid used for the stripping process is preferably water for environmental and economic reasons. However, any liquid capable of being sprayed through the nozzle with sufficient energy to remove the substances can be utilize, such as water-based liquids, conventional cleaning liquids, and others.

Figure 1:
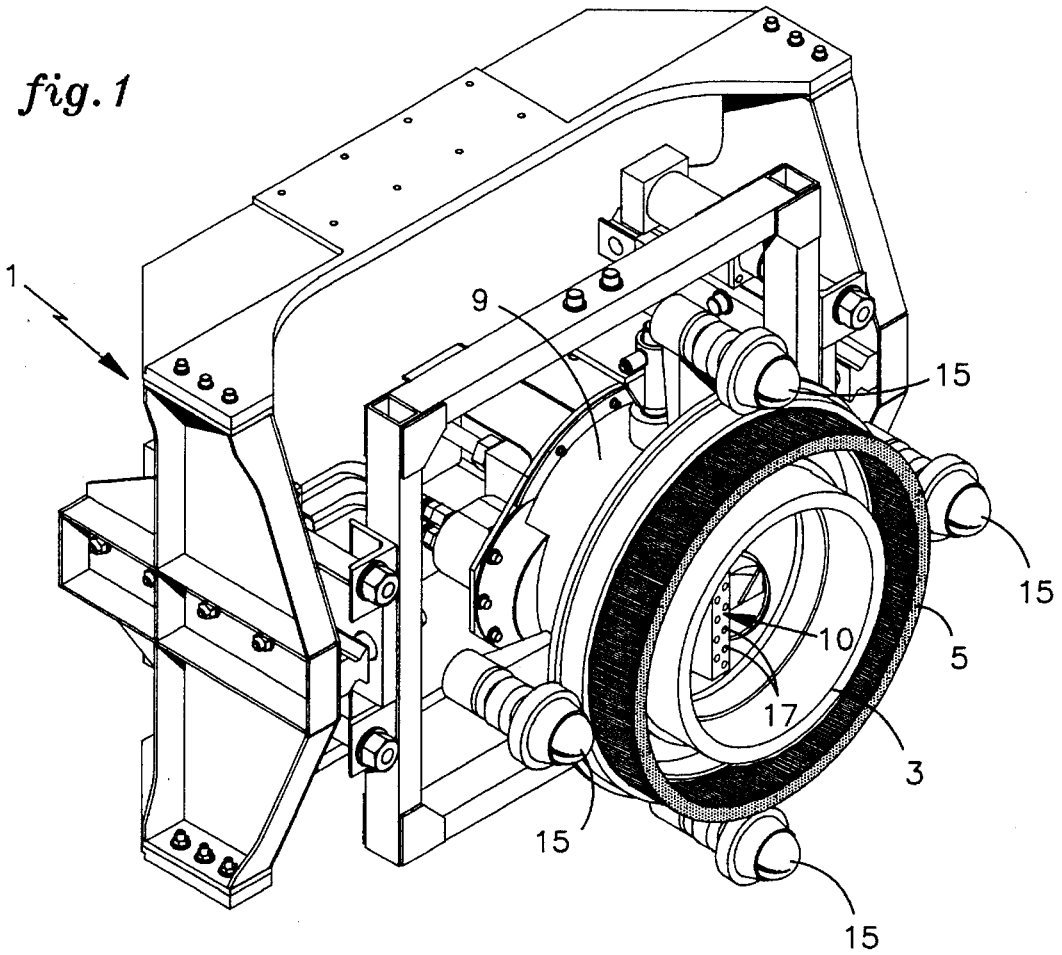
FIG. 1 is a perspective view of one embodiment of the end-effector of the present invention.
Figure 2:
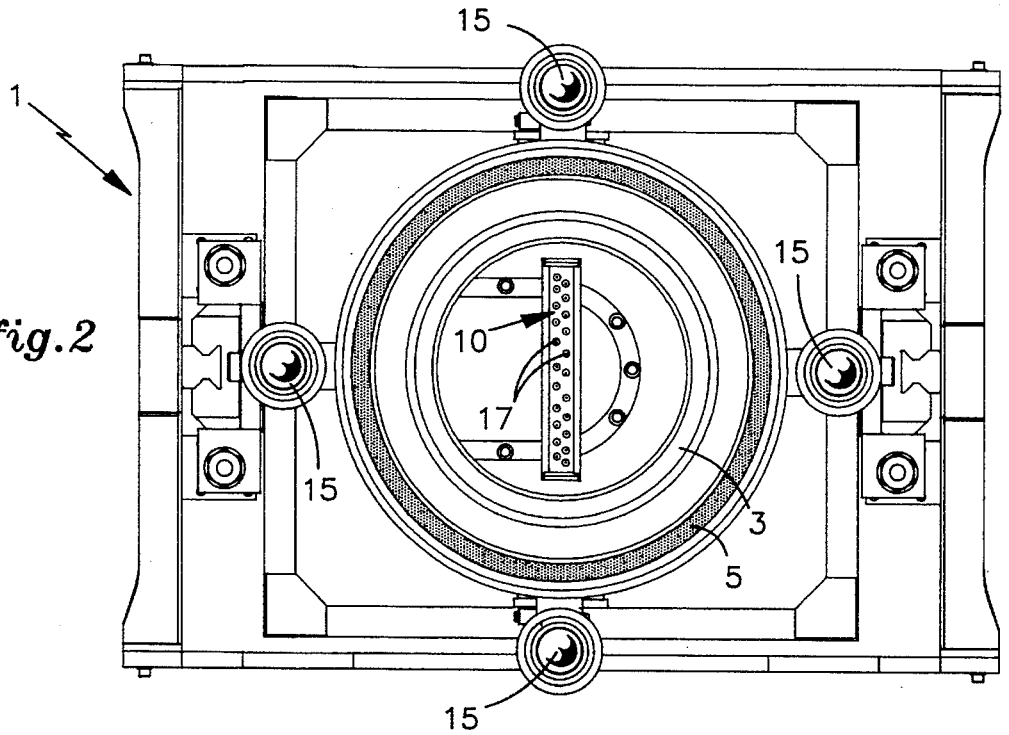
FIG. 2 is a frontal view of the end-effector of FIG. 1.
Figure 3:
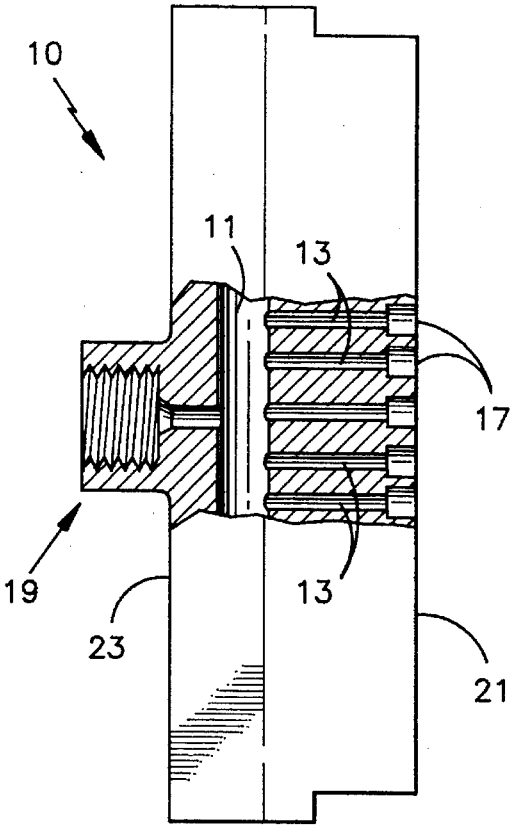
FIG. 3 is a cut away side view of one embodiment of the nozzle of the present invention.
Figure 4:
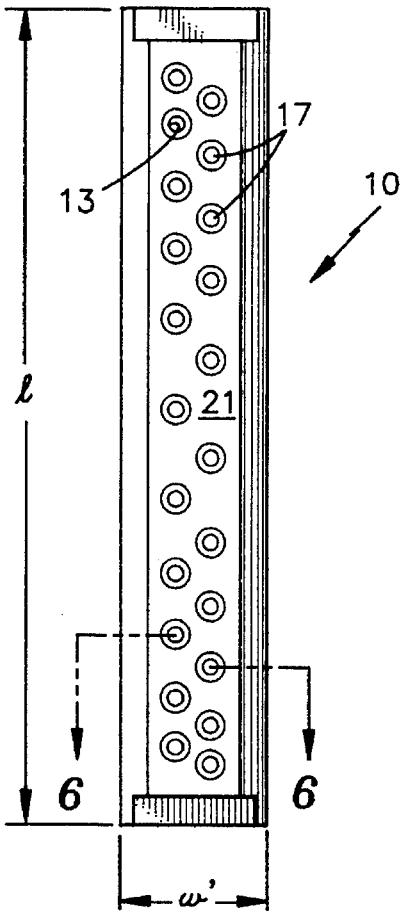
FIG. 4 is a frontal view of the nozzle of FIG. 3.
Figure 5:
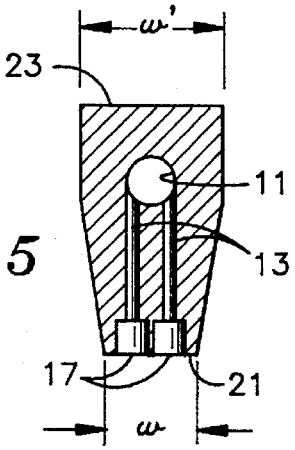
FIG. 5 is a cut-away side view of the nozzle of FIG. 4.
Figure 9:
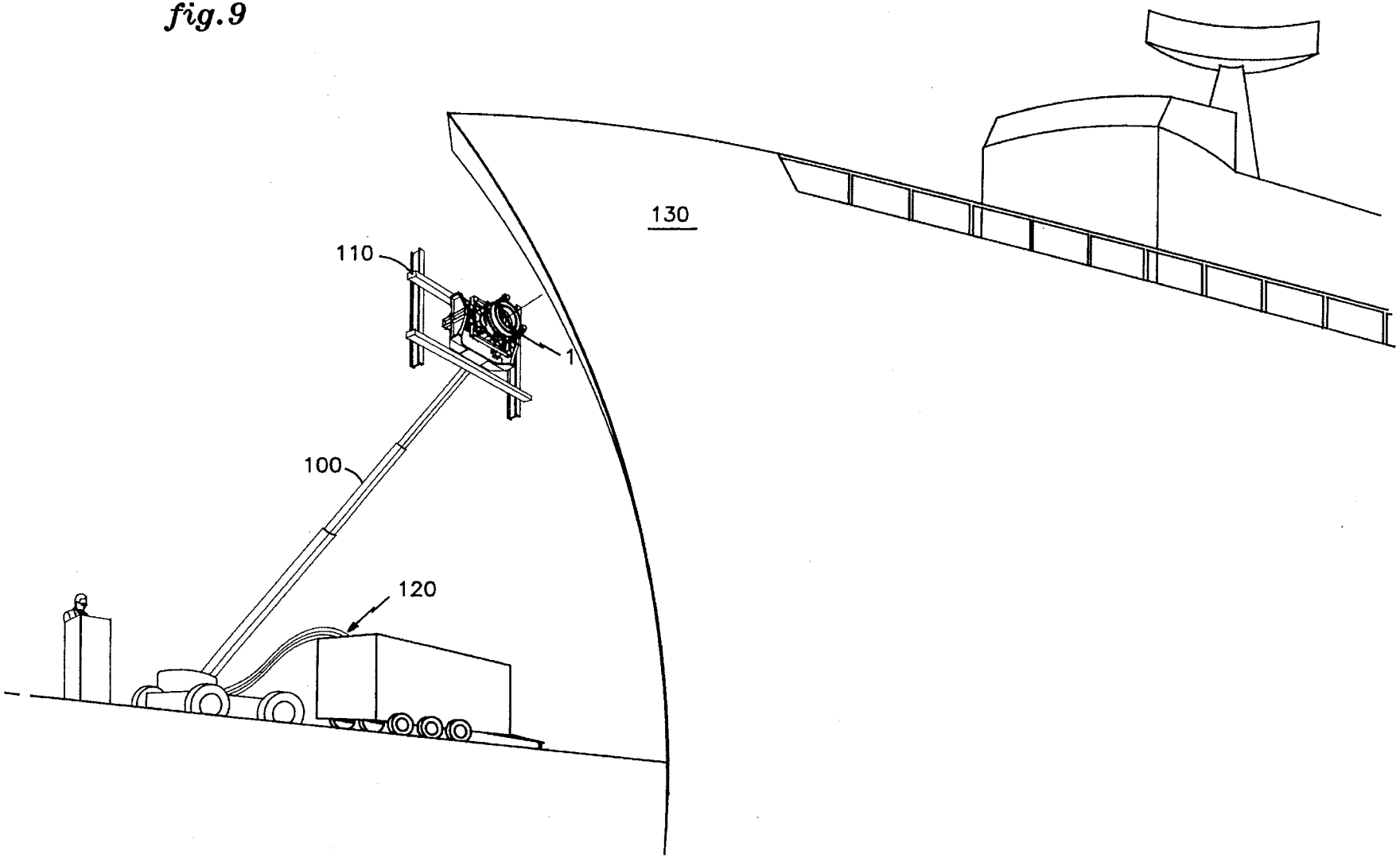
FIG. 9 is an illustration of one use of the stripping system of the present invention.

Referring to FIGS. 1–2, the end-effector 1 has a vacuum enhancing geometry, which is preferably relatively circular, with oval or other substantially rounded shapes acceptable which minimize sharp corners or edges to ensure uniform vacuum throughout the end-effector. This end-effector 1 resides at the end of the manipulator 100 on a frame 110 (see FIG. 9) has a vacuum chamber 9 where a vacuum is created around nozzle 10 located substantially in the center and at one end of the vacuum chamber 9. Brushes 3 and 5 circumferentially disposed around the nozzle 10 capture the effluent and prevent the escape of mist while allowing makeup air to flow into the vacuum chamber 9. The vacuum device (not shown) is connected to the end-effector 1 to create the vacuum in the vacuum chamber 9 and thereby a vacuum between the nozzle 10 and the brushes 3 and 5 such that the effluent is drawn away from the surface, through the vacuum chamber 9 and into the effluent separator 120; rendering the system environmentally sound.

During operation the manipulator 100 positions the end-effector 1 such that the substance can be removed from the desired area of the substrate 130. As a vacuum is created in the vacuum chamber 9, liquid is supplied to the nozzle 10 which preferably rotates and sprays the liquid onto the surface of the substrate, thereby removing the substances. The brushes, which are typically stationary, assist the vacuum by allowing makeup air to flow across the surface of the substrate, thus directing the effluent through the vacuum chamber 9, toward the effluent separator 120. The combination of the nozzle 10, brushes 3 and 5, and the vacuum allow the end-effector 1 to remove substances while leaving the substrate surface substantially clean and dry. For example, on steel surfaces, the effluent is removed such that no flash rusting occurs and the surface can be recoated without further surface cleaning or preparation.

The vacuum can be created by any conventional device capable of creating sufficient vacuum to remove the effluent from the surface and transport it to the effluent separator 120 without significant vacuum pressure loss. Some such devices include: positive displacement blowers with a series of filters and collection devices, liquid ring dry vacuum systems, among others. The vacuum must be able to handle wet/dry material. The vacuum chamber is preferably sealed to prevent air from entering anywhere except across the substrate surface and between the bristles.

The nozzle 10 which includes a plenum chamber 11 and a plurality of bores 13 connecting the plenum chamber 11 to a plurality of orifices 17, is preferably designed to reduce weight while, when rotated, act like an impeller to assist the vacuum in sucking the effluent from the substrate surface, toward the base 19 of the nozzle 10. Other factors which effect the nozzle design include the desired flow collimation (coherency of the flow stream exiting the nozzle), pressure which can be up to about 60,000 psi, and flow pattern characteristics.

One possible nozzle 10 geometry has a substantially rectangular face 21 with the length 1 and width w of the face restricted on the lower end by the desired number of orifices 17. (See FIG. 2) To further reduce weight, the nozzle body is preferably tapered, with the nozzle width w preferably decreasing from the rear of the nozzle 23 to the nozzle face 21. The greatest wall thickness is required round the plenum chamber due to internal burst pressure forces on the chamber inner diameter, while the least wall thickness is required at the orifice end of the nozzle. For example, for a nozzle 10 having twenty-two orifices 17, 1 is 6.50 inches (165.1 mm) while w is 0.80 inches (20.32 mm) and w' is 1.25 inches (31.75 mm) with the dimensions being dependent upon design limitations of the orifice retainers; the housings around the orifices which are typically screwed into the nozzle face 21. In addition to reducing weight, tapering the nozzle body improves the performance of nozzle 10 by enhancing the laminar flow of air around the nozzle body and attaining laminar air flow parallel to the liquid spray formed by the individual streams exiting the orifices 17.

The characteristics of the orifices 17, size and location, are based upon attaining an even energy distribution of liquid across the liquid contact area of the substrate such that substances are uniformly removed across the swath ("cleaned" path which is formed by the liquid spray) without damaging the substrate and without leaving partially cleaned areas. As is disclosed in co-pending patent application, U.S. Ser. No. 07/922,590, (incorporated herein by reference), the orifices 17 are distributed across the face 21 of the nozzle such that, moving from the center of the nozzle to the outer edge, the distance between adjacent orifices 17 generally decreases while the orifice diameter generally increases. These orifices' orientation and diameters are selected in order to attain a substantially uniform cleaning intensity magnitude, when the nozzle rotates and traverses the substrate.

For instance, if a nozzle having a single orifice one inch from the center of the nozzle (or multiple orifices all oriented one inch from the center of the nozzle) is rotated as it traverses a substrate surface, the swath will see uneven cleaning forces such that the edges of the swath will have a high intensity magnitude while the center of the nozzle will have a low intensity magnitude. (see FIG. 6, line 30) In other words, the center of the swath will not be sufficiently cleaned, with a strip of contaminants remaining in the center of the swath, while the edges of the swath will be cleaned, or the center of the swath will be cleaned while the edges of the swath may show substrate damage due to the high intensity of the energy striking those locations.

Figure 7:
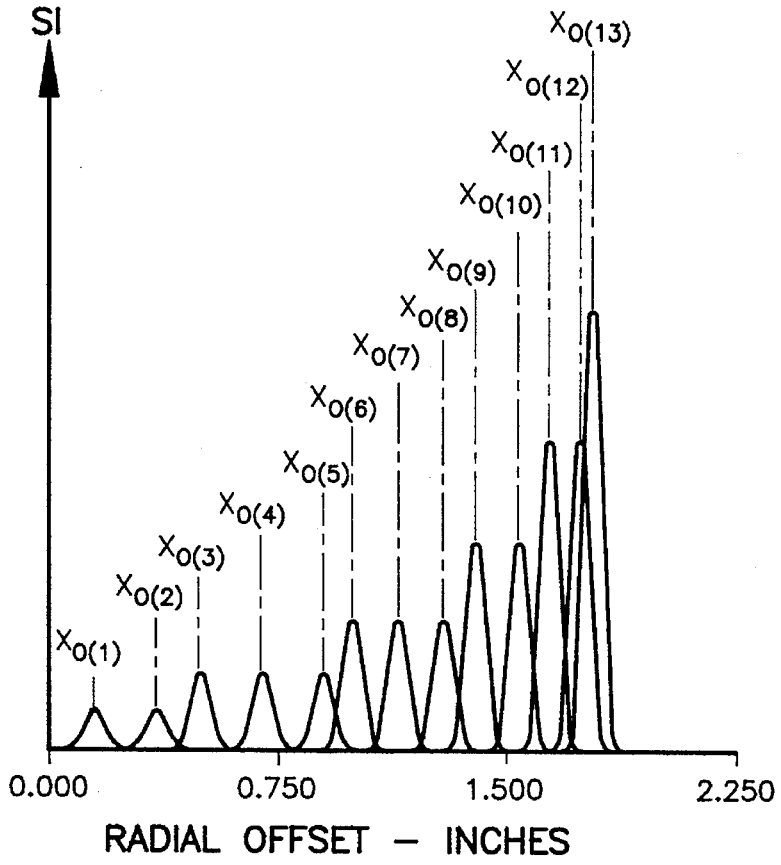
FIG. 7 is an illustration of the magnitude spectrum showing individual orifice intensity distributions for an nozzle which exhibits an even energy profile.

Similarly, if multiple orifices having the same diameter are oriented on the nozzle at different distances from the center of the nozzle, the intensity magnitude will still vary across the swath, as shown in line 32, with a peak corresponding to each orifice instead of one peak as in line 30 (see FIG. 7). The orifice closest to the center of the nozzle will create a high intensity magnitude, and the orifices further from the center of the nozzle will produce decreasing intensity magnitudes. In this instance, the center of the swath, which corresponds to the area 34 of line 36, and the edges of the swath, corresponding to peaks 36 and 38, will have a relatively low intensity magnitude and therefore will not be sufficiently cleaned by the liquid spray or if cleaned, the area of the swath corresponding to the peaks, particularly the highest peak 40, may be damaged. Essentially, this nozzle will either leave streaks of contaminants on the surface of the substrate or potentially damage the substrate.

Figure 6:
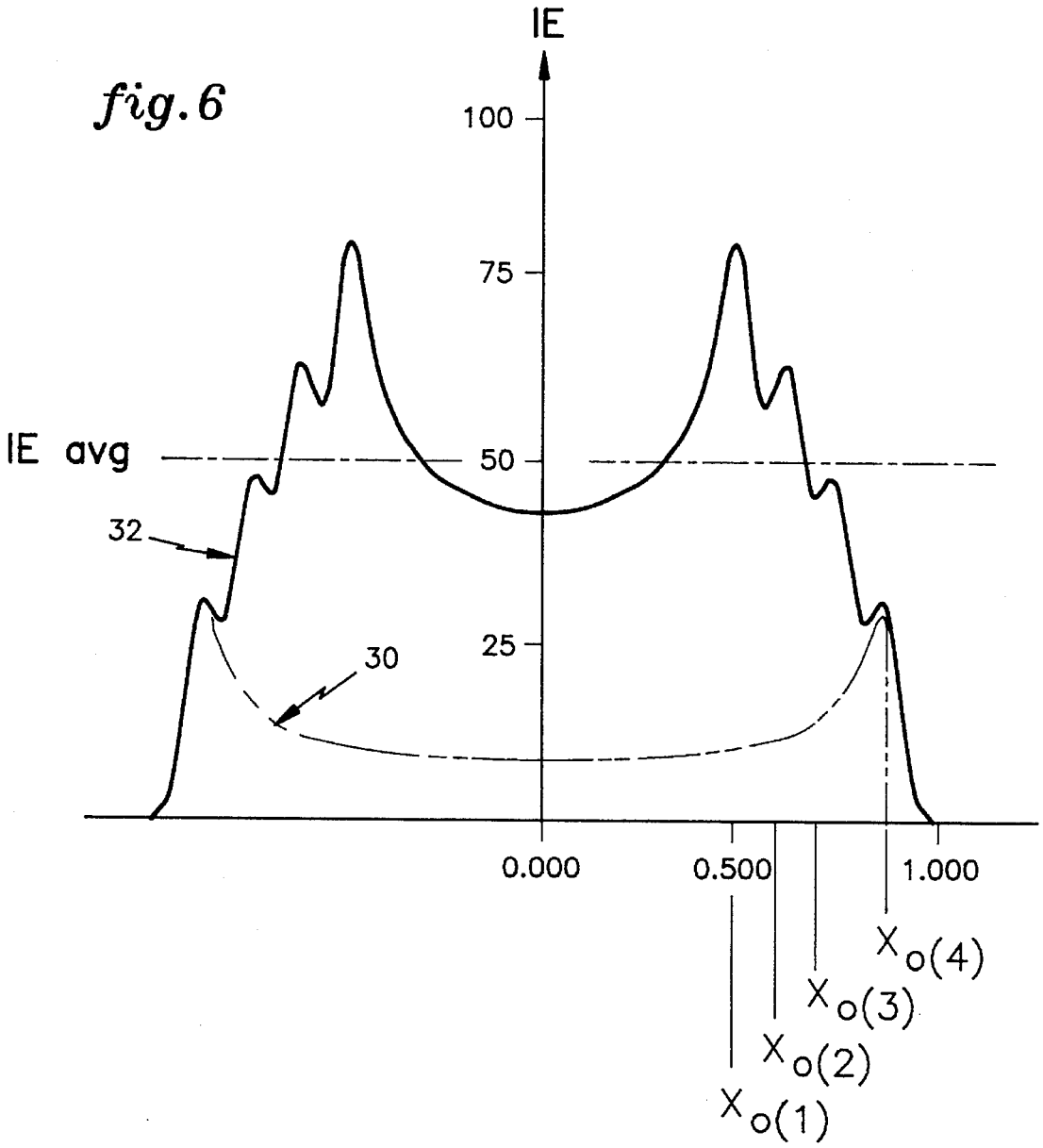
FIG. 6 is an illustration of the incident energy of a conventional rotating nozzle which traverses the surface of a substrate.
Figure 8:
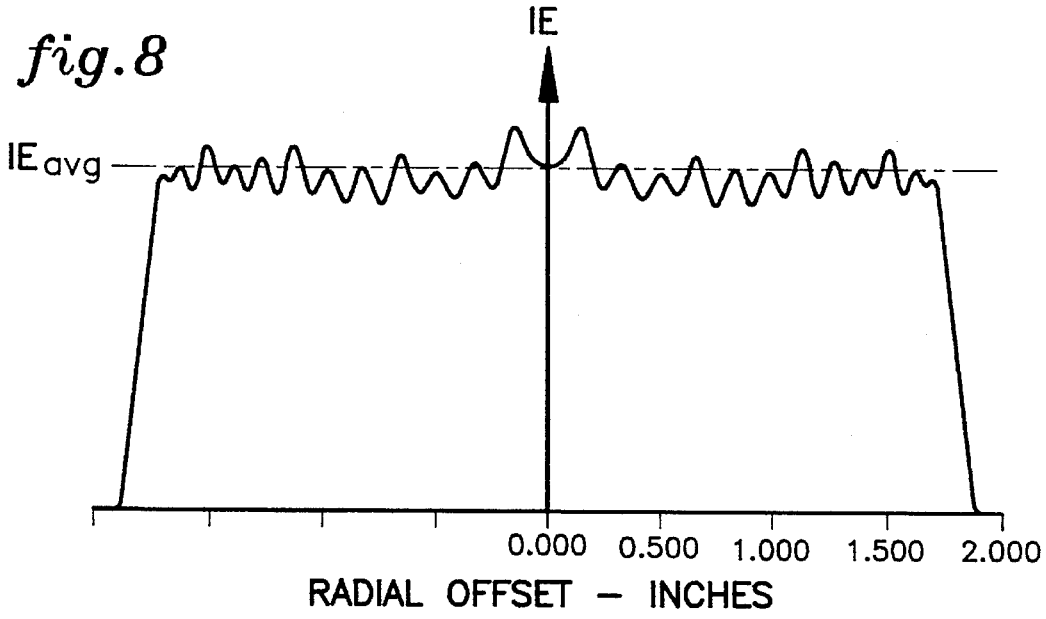
FIG. 8 is an illustration of the incident energy for the nozzle of FIG. 7 once it rotates and traverses the substrate.

Preferred orientation of the orifices and the diameters thereof are determined theoretically via an incident energy profile as shown in FIGS. 6–8 which are meant to be exemplary, not limiting. The number of orifices is generally based on the size of the substrate to be cleaned, the type of material removed, the nozzle size, the flow rate attained with the pump at the desired pressure, and the desired energy of the liquid spray.

Additional factors in attaining an even energy distribution of the spray are the rate of rotation (revolutions per minute "rpm") and traverse speed. The preferred rpm is a balance between sufficiently rotating the nozzle to attain the even energy distribution while minimizing rotation speed to increase the liquid spray energy. Up to about 500 rpm or more can be used, with about 200 to about 500 rpm preferred, and about 300 to about 400 rpm especially preferred.

The graphs depicted in FIGS. 6–8 were obtained utilizing the following equations:

$$SI_1[X] = \frac{1}{C_1} \times e^{\frac{-(X-X_0)^2}{C_2}} \qquad \text{Equation 1}$$

$$N = \int_{X=0}^{X_0+6\sigma} 2\pi \times \frac{1}{C_1} \times e^{\frac{-(X-X_0)^2}{C_2}} \times dX \qquad \text{Equation 2}$$

$$IE[X] = \int_{Y-0}^{Y-\infty} \frac{1}{C_1 N} \times e^{\frac{-(\sqrt{(X^2-Y^2)}-X_0)^2}{C_2}} \times dY \qquad \text{Equation 3}$$

-continued $$IE[X]_{avg} = \frac{1}{{}_{max}X_0} \times \int_{X-0}^{{}_{max}X_0} \times \sum_{orifice-1}^{orifice-n} IE[X] \times dX \quad \text{Equation 4}$$

SI=stripping intensity magnitude $C_1$=constant which is inversely proportional to the cube of the orifice diameter $C_2$=constant $X_0$=orifice offset from the center of the orifice N=area under the cylinder cross section along the X axis IE=incident energy delivered to the surface The orifices 17 receive liquid from the plenum chamber 11 which functions as a reservoir capable of maintaining a substantially uniform liquid supply and pressure to each orifice 17. Therefore, the plenum chamber 11 has sufficient volume to maintain the desired pressure and to supply sufficient liquid to each orifice 17, and preferably sufficient diameter to allow a direct path from the plenum chamber 11 to each orifice 17 without additional turns/bends in the liquid pathway. The plenum chamber 11 and nozzle 10 should be sized proportionally to provide a sufficient safety factor to prevent structural fracture due to over pressurization, while at the same time minimizing weight. The pressure is typically up to about 60,000 psi (4, 137 bar), with about 30,000 to about 40,000 psi (about 2,068 to about 2,758 bar) preferred.

Within the nozzle 10, the plenum chamber 11 connects to the orifices 17 via a series of bores 13. Each bore 13 has a diameter sufficient to supply the desired flow rate of liquid to an orifice 17, a length sufficient to orient the water in a laminar flow pattern upon reaching that orifice 17, and preferably a geometry and relatively smooth walls to enhance that laminar flow. The particular bore length and diameter can be readily determined by an artisan. For example, in a 35,000 psi system with a 0.120 inch (3.048 mm) bore diameter, the bore length to diameter can be about 4:1 to about 20:1, with about 12:1 preferred.

With respect to the geometry of the bores 13, a cylindrical bore is commonly utilized do to manufacturing limitations. However, a bore having substantially conical shape, converging in the direction of the liquid flow, i.e. from the plenum chamber 11 to the orifices 17, is preferred due to the improved flow and pressure characteristics attained thereby. Typically the degree which the bore walls converge is up to about 25°, with about 10° to about 15° preferred.

The nozzle is complimented by at least one brush circumferentially disposed therearound. The brush assists in removing the substances from the substrate, directing the effluent into and preventing it from escaping from the vacuum chamber 9, supplying make-up air thereto, and maintaining a sufficient vacuum between the surface of the substrate and the end-effector 1. The distance between the nozzle 10 and the first brush 3, and between subsequent brushes (5) is determined according to the desired vacuum characteristics. The distance between the nozzle 10 and the first brush 3 should be sufficient to prevent the brush bristles from being pulled into the vacuum chamber 9, which can cause excessive bristle wear, while assisting in directing the effluent to the vacuum chamber 9. Additional brushes, such as the second brush 5, act as seals that capture mist which escapes through the first brush 3. Typically, the distance between the first brush 3 and the nozzle 10 is up to about 3 inches (about 76.2 millimeters (mm)), with about 0.5 inches (about 12.7 mm) to about 1.5 inches (about 38.1 mm) preferred for an about 6 inch (about 152.4 mm) to an about 7 inch (about 177.8 mm) nozzle and an 18 inches (457.2 mm) of mercury vacuum. Meanwhile, the distances between subsequent brushes such as between brushes 3 and 5 is typically up to about 3 inches (about 76.2 mm), with about 0.5 to about 1 inches (about 12.7 to about 25.4 mm) preferred.

Important brush characteristics include: brush diameter, distance from the nozzle 10, and bristle density, length, stiffness, arrangement, and location; with the bristle density, stiffness, and location dependent upon the vacuum characteristics, the seal function of the brushes, and preventing the bristles from being drawn into the vacuum chamber 9. The brush diameter is sufficiently large to maintain contact between the substrate surface and the bristles at all times, thereby maintaining the vacuum and preventing effluent leakage. The bristles are typically arranged in staggered tufts having a diameter of about 0.156 inch (3.96 mm) or larger, with about 0.125 inch (3.175 mm) to about 0.25 inch (6.35 mm) diameter tufts common for a vacuum of about 18 inch (457.2 mm) of mercury. For such a brush, medium to high stiffness bristles with a bristle diameter exceeding about 0.01 inches (0.254 mm) can be employed to form the tufts, with about 0.014 inch (0.3556 mm) to about 0.020 inch (0.508 mm) diameter bristles preferred. Sufficient tuft density, i.e. rows, is employed to prevent effluent from escaping around protuberances such as weld beads, rivets, or others, while not choking the vacuum by restricting make-up air flow. The tuft density can be up to about 25 rows or more, but typically ranges from about 5 to about 15 rows, with about 8 to about 12 rows generally preferred for a 1.5 inch (38.1 mm) wide brush.

As stated above, the brush bristles should remain in contact with the surface at all times and the stand-off distance from the substrate surface to the nozzle should be substantially maintained to provide uniform stripping results with slight compression of the bristles acceptable. For example, the bristles should be of sufficient length to allow protuberances to pass though the bristles, but not too long so that the vacuum pulls the bristles into the vacuum chamber 9. Lengths of about 0.5 inches (about 12.7 mm) to about 3.0 inches (about 76.2 mm) or longer can be used, with about 0.85 to about 1.75 inches (about 21.59 to about 44.45 mm) preferred, and about 1.0 to about 1.25 inches (about 25.4 to about 31.75 mm) especially preferred. The nozzle stand-off distance is typically up to about 10 inches (about 254 mm) with about 0.5 to about 8.0 inches (about 12.7 to about 203.2 mm) preferred and about 2.0 inches (about 50.8 mm) to about 3.0 inches (about 76.2 mm) especially preferred since this allows for a half inch (12.7 mm) protuberance to pass through the bristles while keeping the nozzle close enough to the surface to strip efficiently.

Maintenance of the nozzle stand-off distance is typically accomplished via the use of a plurality of casters 15. The casters 15 should be of a large enough radius to allow them to roll over a protuberance such as a weld bead or rivet. One type of caster 15 that can be use is the ball type caster which should be rugged and designed to avoid interference with the protuberance while allowing the ball to contact and roll over the protuberance. Typically, up to about 5 inch (about 127 mm) diameter casters 15 are employed for use in stripping substances from a ship, with about 1 inch (about 25.4 mm)to about 4 inch (about 101.6 mm) diameter preferred, and about 2 inch (about 50.8 mm) to about 3 inch (about 76.2 mm) diameter especially preferred. It should be noted that a constant back force is preferably applied to the end-effector 1 to overcome the liquid back-thrust, keep the brush(es) in contact with the surface, and maintain the stand-off distance.

In order for the end-effector 1 to effectively remove the substances from the substrate, it preferably gimbals on at least two axes and translates to/away from the surface in order to accommodate surface contours and to maintain proper stand-off. The gimballing is accomplished via the frame 110 which attaches the end-effector 1 to the manipulator 100. This frame 110 allows movement of the end-effector 1 in the X and Y planes while the manipulator 100 moves the end-effector 1 in the Z plane.

The present invention will be clarified with reference to the following illustrative example. This example is given to illustrate the process of removing substances from a substrate using the stripping system of the present invention. It is not, however, meant to limit the generally broad scope of the present invention.

Example

A 6 inch diameter, twenty-two orifice nozzle having a 0.438 inch (11.13 mm) diameter, 6.30 inch (160.0 mm)long plenum chamber, 0.120 inch (3.05 mm) diameter and 1.40 inch (35.56 mm)long bores, orifice sizes from 0.006 inches (0.1524 mm) to 0.017 inches (0.4318 mm), a face length of 6.50 inches (165.1 mm) and body widths of (w) 0.8 inches (20.32 mm) and (w') 1.25 inches (31.75 mm), was located in a vacuum chamber having an 8 inch (203.2 mm) inner diameter. Double circular brushes having 8 inch (203.2 mm) inner diameter, 11 inch (279.4 mm) outer diameter; 12 inch (304.8 mm) inner diameter and 14 inch (355.6 mm) outer diameter, respectively, bristle diameter of 0.014 inch (0.36 mm) each, and tuft densities of 10 rows and 5 rows respectively, were circumferentially disposed around the nozzle. With pressures of about 10,000 to about 40,000 psi (about 690 to about 2,758 bar), flow rates of about 3 to about 11 gallons per minute, and traverse speeds of about 1 to about 3 inches (about 25.4 to about 76.2 mm) per second, marine growth, antifoulant paint, anticorrosive paint, primer, corrosion, and non-skid flight deck coating were removed from and aircraft carrier and a submarine at a rate of about 150 to about 300 square feet per hour with complete recovery; nearly 100%, with no residual water or effluent remaining. The stripped surface was dry and ready for immediate repainting without additional surface cleaning or preparation required.

The advantages of the stripping system of the present invention include: complete or selective substance removal, complete effluent recovery, faster removal rates than manual abrasivc blasting, and efficient, effective removal from contoured surfaces and surfaces with protuberances. Conventional removal processes can cost millions of dollars for the contaminant clean-up and disposal which are substantially eliminated with the system of the present invention. Furthermore, the prior art removal processes typically required additional surface preparation, i.e. cleaning if dry grit blasting was employed or de-rusting if water/garnet abrasive blasting was used. In contrast, the system of the present invention renders the surface ready for immediate re-application of the paint or other coating.

Although this invention has been shown and, described with respect to detailed embodiments thereof, it will be understood by those skilled in the art that various changes in form and detail thereof may be made without departing from the spirit and scope of the claimed invention.

We claim:

1. A stripping system for removing substances from a surface comprising: an end-effector having a nozzle, a first brush circumferentially disposed around said nozzle at a sufficient distance from said nozzle to allow the formation of a vacuum therebetween, an additional brush spaced from said first brush, wherein each of said brushes has bristles arranged in tufts of at least one bristle and has sufficient tuft density to prevent the escape of effluent from the end-effector, a liquid supply connected to said nozzle; and a vacuum chamber disposed about said nozzle, said vacuum chamber enclosing a vacuum created by a vacuum device connected to said vacuum chamber, said vacuum being sufficient to recover effluent, wherein said first brush assists in directing the effluent into the vacuum chamber and said additional brush acts to capture any effluent which may escape through the first brush, said brush arrangement and the vacuum formed between said nozzle and said brush being sufficient to substantially completely remove the effluent from the surface.

2. A stripping system as in claim 1 wherein said nozzle comprises:

a. at least one orifice;

b. a plenum chamber for maintaining a pressure and uniform liquid supply to said orifice; and c. a bore connecting each orifice to said plenum chamber, wherein said bore has a sufficient length to cause liquid flowing from said plenum chamber to said orifice to have a laminar flow pattern upon reaching said orifice.

3. A stripping system as in claim 2 wherein said bores have walls with a conical geometry.

4. A stripping system as in claim 3 said walls converge from said plenum chamber toward said orifice at an angle of up to about 25°.

5. A stripping system as in claim 2 wherein said bore has a length to diameter ratio of about 4:1 to about 20:1.

6. A stripping system as in claim 2, wherein said orifice is sized and oriented so as to create an even energy distribution of liquid which contacts the surface.

7. A stripping system as in claim 2 wherein said plenum chamber has sufficient volume to maintain the desired pressure and liquid supply sufficient liquid to each orifice, and a sufficient size to allow a direct path from said plenum chamber to each orifice without bends in the liquid pathway.

8. A stripping system as in claim 2 wherein said bores have walls with a cylindrical geometry.

* * * * *